US005863613A

United States Patent [19]

Emch

[11] Patent Number: 5,863,613

[45] Date of Patent: Jan. 26, 1999

[54] APPARATUS AND METHOD FOR SPRAY PAINTING OF AN ARTICLE

[75] Inventor: Donaldson J. Emch, Brighton, Mich.

[73] Assignee: PPG Industries, Inc., Pittsburgh, Pa.

[21] Appl. No.: 770,863

[22] Filed: Dec. 20, 1996

[51] Int. Cl.[6] ..... B05D 1/02; B05D 1/04

[52] U.S. Cl. ..... 427/422; 427/421; 427/426; 427/479; 118/302; 239/13

[58] Field of Search ..... 417/421, 422, 417/479, 458, 426; 118/300, 315, 302; 239/3, 13, 75, 135, 139, 132.1

[56] References Cited

U.S. PATENT DOCUMENTS

| | | | |
|---|---|---|---|
| 3,870,233 | 3/1975 | Wilhelm et al. | 239/15 |
| 3,880,228 | 4/1975 | Houk et al. | 165/30 |
| 4,114,682 | 9/1978 | Knud | 165/39 |
| 4,465,922 | 8/1984 | Kolibas | 219/304 |
| 4,501,952 | 2/1985 | Lehrke | 219/305 |
| 5,170,939 | 12/1992 | Martin | 239/112 |
| 5,197,676 | 3/1993 | Konieczynski et al. | 239/690 |
| 5,271,569 | 12/1993 | Konieczynski et al. | 239/690 |
| 5,395,451 | 3/1995 | Triculis | 118/666 |
| 5,538,186 | 7/1996 | Konieczynski . | |

*Primary Examiner*—Shrive Beck
*Assistant Examiner*—Michael Barr
*Attorney, Agent, or Firm*—Kenneth J. Stachel; Dennis G. Millman

[57] ABSTRACT

An apparatus and method for spray painting of an article where the paint is heated to reduce the viscosity prior to being fed to a paint spray device such as an electrostatic paint spray device. A heat exchange unit is provided between each of a plurality paint supply sources and a paint spray device of a paint spray station, the heat exchange unit located closely adjacent to a respective paint spray device such that only paint being supplied to a paint spray device is heated by a respective heat exchange unit. The heat exchange unit preferably uses a hot dielectric oil for indirect heat exchange with the paint, and preferably a volume of heated paint between a heat exchange unit and a respective paint spray device is only about 15 percent or less of the volume of paint in the heat exchange unit, while the volume of heated paint is about one to three times the volume per minute of flow through the heat exchanger.

10 Claims, 2 Drawing Sheets

APPARATUS AND METHOD FOR SPRAY PAINTING OF AN ARTICLE

BACKGROUND OF THE INVENTION

The present invention relates to an apparatus and method for spray painting of an article, such as an automobile body, with a paint having a high viscosity, where the paint is heated to reduce the viscosity and enable ready spray application by an electrostatic spray device.

The spray painting of an article, such as an automobile body, is often carried out by use of electrostatic spray devices and uses a variety of paint compositions. Generally, such paint compositions have high viscosities and the viscosity must be lowered for use in electrostatic spraying by either dilution with a solvent or diluent or heated to a temperature at which the viscosity is low enough for application. Both such procedures provide further problems. The use of solvents or diluents provides unwanted volatile components that must be contained and disposed of, or recovered, adding to the cost of the paint system, and also can cause problems in the application of the paint to a surface, such as runs, drips, sags, solvent popping or trapping, or the like. The heating of the paint composition, while reducing the amount of unwanted additional components such as solvents or diluents, and reducing the viscosity of the composition, can lead to problems where the paint composition is unstable if exposed to heat for any extended period of time, and if spraying is interrupted, the heated paint composition may begin to react or form a gel.

An example of a prior art paint system for an automotive plant where heating is used to reduce the viscosity of the paint composition is given in U.S. Pat. No. 5,395,541 which shows the use of a plate type heat exchanger for each circulation loop, with the heat exchanger connected in parallel in a single water circulation loop. Another prior art paint temperature control system using a heat exchanger is described in U.S. Pat. No. 3,880,228. In the system described in U.S. Pat. No. 3,880,228, a heat exchanger zone is used with means for continuously circulating a heat exchange fluid into and through the heat exchanger zone and means are also provided for directing a relatively small stream of paint into heat exchange relationship with the fluid, such as hot oil, in the heat exchange zone, the mass velocity of the paint stream being substantially smaller than the mass velocity of the hot fluid. The paint is thus heated only once as it passes to a painting apparatus from the heat exchanger, but the paint is constantly circulated at ambient temperature to and from a paint reservoir.

SUMMARY OF THE INVENTION

An apparatus and method are provided for spray painting of an article using a paint composition of a high viscosity, where the paint is heated to reduce the viscosity thereof at a location closely adjacent to a spray device used to spray the heated paint composition onto an article.

The apparatus has at least one paint station, having a plurality of paint spray devices, such as electrostatic rotary atomizers. A plurality of paint supply sources are provided, one for each of the paint spray devices and a plurality of heat exchange units are provided, one positioned between each of the paint supply sources and a respective paint spray device of a spray station, with each heat exchange unit located closely adjacent to a respective paint spray device. The heat exchange units are preferably metallic heat exchangers that use a hot dielectric oil as a heat exchange medium for indirect transfer of heat to the paint and the volume of paint heated in each heat exchange unit is only about 100 to 1000 cc, preferably 100 to 500 cc, and the volume of heated paint between each heat exchange unit and each spray device is 15 percent or less of the volume of the heat exchange unit, or only about 15 to 150 cc of heated paint, preferably about 15–75 cc. Also, in order to keep the volume of heated paint at a minimum, the volume of heated paint should be between about only one to three times the volume per minute of flow of the paint through the heat exchange unit.

The present method for the spray painting of an article with a high viscosity paint provides a plurality of paint spray devices, such as electrostatic spray devices, at least one paint spray station, a supply of paint to each of the paint spray devices, and a heat exchange unit between each of the paint supplies and a paint spray device, which heat exchange unit is located closely adjacent to the paint spray device. The supply of paint to a paint spray device is heated in the heat exchange unit, such as by indirect heat transfer from a hot fluid, preferably a hot dielectric oil, and fed to the paint spray device through a conduit, and the article sprayed by heated paint through the paint spray device. Preferably, the conduit between the heat exchange unit and a respective paint spray device is sized such that only an amount of about 15 percent or less of the volume of paint in the heat exchange unit is provided in the conduit at any point in time, and the volume of heated paint at any one point in time is only about one to three times the volume per minute of flow through the heat exchange unit.

DESCRIPTION OF THE DRAWINGS

The apparatus and method of the present invention will become more readily apparent by reference to the following detailed description and the accompanying drawings, wherein.

DETAILED DESCRIPTION

Figure 1:
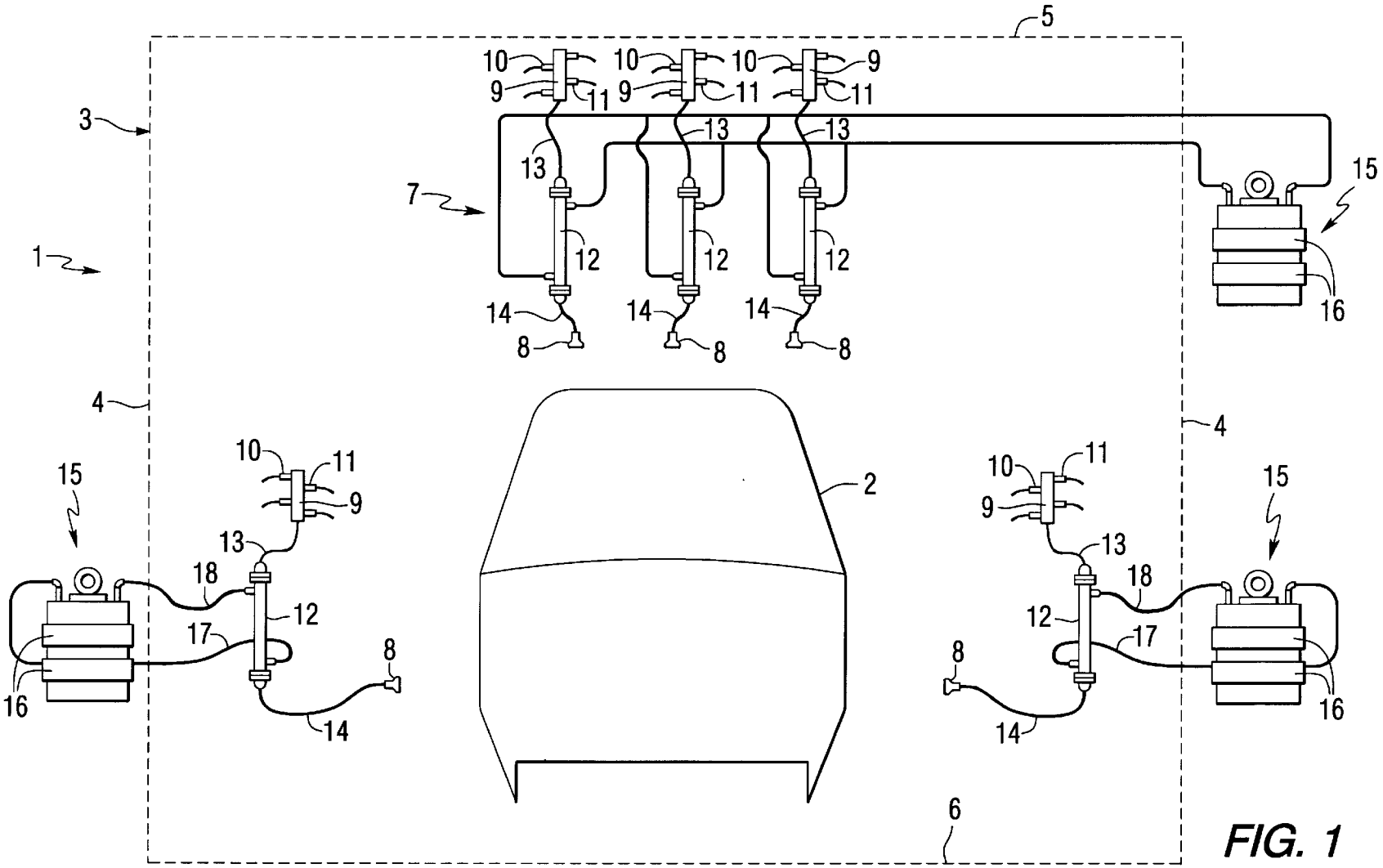
FIG. 1 is a illustration from an end of a spray booth illustrating an apparatus of the present invention.

The present apparatus and method provide a system for spray painting of an article with a paint composition having a viscosity at room temperature that is too high for use with a spray device, such as an electrostatic rotary atomizer. In accordance with the present system, the paint composition is heated in small portions only, and only at a location closely adjacent to the spray device, in order to prevent possible damage to the paint composition and/or to the extended presence of a heated paint composition in the spray apparatus.

At least one, and preferably a series of paint stations are provided in a spray booth which are arranged so as to paint spray an article, such as an automobile body, with side spray stations and a top spray station generally present. Each spray station has a plurality of paint spray devices, such as electrostatic rotary atomizers which are used to spray a paint composition, such as a colored paint, a primer, or a seal coat onto the article. Such electrostatic rotary atomizers are known in the art and commercially available. In order to provide a supply of the paint to the paint spray devices, a plurality of paint supply sources are used, one provided for each of the paint spray devices. The paint supply sources may include means for the addition of coloring material to a base paint composition depending upon the desired paint spray to be used to spray the article.

In order to reduce the amount of the paint that is heated when supplied to the plurality of paint spray devices, a plurality of heat exchange units are provided, a separate heat exchange unit being positioned between each of the paint supply sources and a respective paint spray device of a spray station, with each of the heat exchange units located closely adjacent to a respective paint spray device. The heat exchange units are preferably conventional tube-and-shell or coil-in-tube heat exchangers and are designed to heat the paint composition by indirect heating through the use of a heated fluid, such as (in the case of a tube-and-shell heat exchanger) by passage of the paint through a bundle of axially aligned paint supply tubes contained in a cylindrical housing, with a heated fluid inlet and outlet on the housing which provides for circulation of a hot heat transfer fluid about the bundle of paint supply tubes. Also, where the paint composition is comprised of two or more reactive materials, each of the components may be fed to the heat exchange unit separately and heated separately therein, with mixing of the two or more components after heating and prior to entry into the respective paint spray device. The heat exchange unit is preferably composed of a non-corrosive metal or alloy, such as 316 stainless steel. The heat exchange unit should have a capacity sufficient to provide the necessary quantity of heated paint compositions to a paint spray device without heating any unnecessary such paint composition. Preferably, the capacity, or volume, of the heat exchange unit would be between about 100 to 1000 cc of paint, and more preferably between about 100–500 cc of paint. An example of such a heat exchanger, provided by St. Clair Systems of Romeo, Mich. is a stainless steel cylinder about 20 inches long and of 2.5 inches in diameter with an axial bundle of 318 inch stainless steel tubes, with a paint capacity of 250 cc.

With the use of electrostatic spray devices, the heat exchange fluid fed to the heat exchange unit to heat the paint should be a high dielectric oil, i.e. an oil having a dielectric value sufficient to prevent any bleed-off of voltage or current from the electrostatic spray device to the heat exchange unit. An example of such a high dielectric oil is DIALA OIL AX sold by Shell Oil Company. Preferably, a common oil supply is used to heat the oil that is provided to a plurality of heat exchange units and the common oil supply, such as a drum heated, for example, by electric band heaters attached to the drum, is located outside the spray booth, with oil supply transfer lines communicating between the common oil supply and the associated plurality of heat exchange units of the paint station located inside the spray booth.

Also, in order to reduce the amount of paint that is heated when supplied to the plurality of paint spray devices, each of the heat exchange units is located closely adjacent to a respective paint spray device and connected thereto by a conduit, of a capacity such that a volume of heated paint of only about 15 percent or less, preferably 10 percent or less, of paint capacity of the heat exchange unit is present between the heat exchange unit and a respective spray device. For example, with a heat exchange unit having a volume of 100–1000 cc of the paint, the conduit between the heat exchange unit and a respective paint spray device would be between about 15–150 cc of heated paint. In addition, if desired, the conduit between a heat exchange unit and a respective paint spray device may be provided with a heat insulating material so as to better retain the temperature of the paint during short interruptions in the spraying operation.

In addition, in order to reduce the amount of paint that is heated when supplied to each of the plurality of paint spray devices, the volume of heated paint, i.e. the volume (e.g. ccs) of the heat exchange unit and a conduit connecting a heat exchange unit to a respective paint spray device, should be between about one to three times the volume per minute of flow (e.g. ccs/minute) through the heat exchange unit. For example, when using a heat exchange unit having a capacity of 250 cc, a flow rate of about 125 to 250 cc/minute would be provided through the heat exchange unit and associated conduit to a spray device.

According to the present method, spray painting of an article is effected by heating a paint composition to reduce the viscosity thereof prior to passage to a paint spray device. A plurality of paint spray devices, such as electrostatic rotary atomizers, are provided at each of a series of paint stations, and a supply of paint provided to each of the paint spray devices. A heat exchange unit is provided for each of the paint spray devices at a location closely adjacent thereto, such that a heated paint supply of a volume of only about 15 percent or less of the paint volume of the heat exchange unit is provided between the heat exchange unit and a respective paint spray device. For example, the heat exchange unit would have a volume of paint of only between about 100–1000 cc of paint indirectly heated at any point in time while only about 10–150 cc of heated paint is provided between a heat exchange unit and a respective paint spray device at any point in time. Also, the volume of paint heated would be about one to three times the volume per minute of flow of the paint through the heat exchange unit at any point in time.

The paint is heated in the heat exchange unit by indirect heating using a hot fluid. The hot fluid, where electrostatic paint spray devices are used is a high dielectric oil. The paint should be heated in the heat exchange unit from ambient temperature to a temperature of between about 100° to 250° F., preferably 120° to 200° F., to achieve ready spraying by an electrostatic spray device, and the temperature of the heat exchange fluid, such as a high dielectric oil, will depend upon the initial temperature of the paint supply and capacity of the heat exchange unit.

Figure 2:
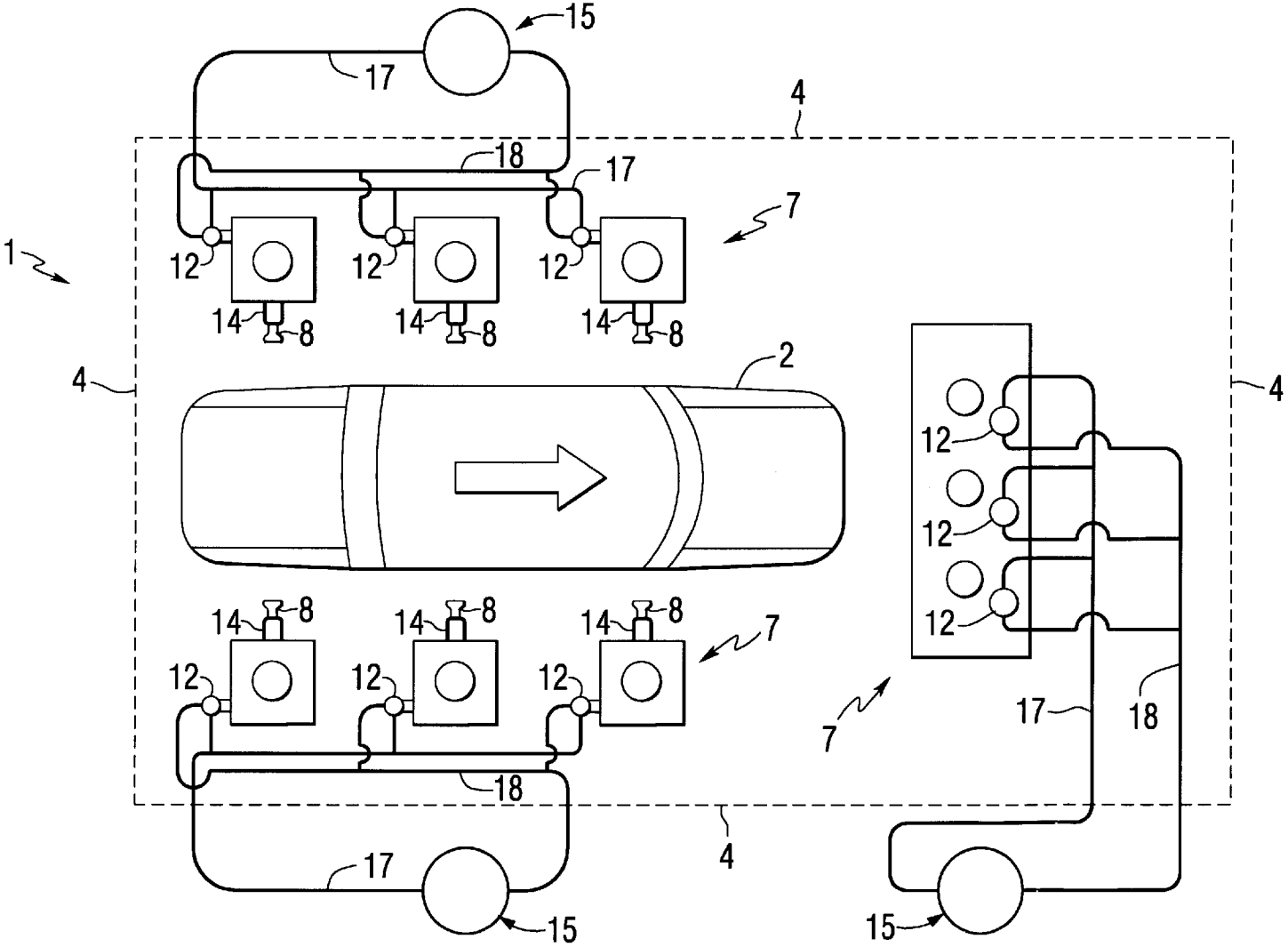
FIG. 2 is a view from the top of the spray booth illustrated in FIG. 1.

Referring now to the drawings, an apparatus 1 for spray painting an article such as an automobile body 2 is illustrated. As shown in FIG. 1 and 2, the automobile body 2 is preferably enclosed in a spray booth 3 having walls 4, ceiling 5 and floor 6, with means for placement of the automobile body in the spray booth 3 and removal therefrom. In the illustrated embodiment, a series of paint stations 7 are provided in the spray booth 6, each spray station having a plurality of paint spray devices 8, such as electrostatic rotary atomizers. A plurality of paint supply sources 9, such as paint supply mixers, are provided, preferably one such paint supply source 9 being present for each of the paint spray devices 8. The paint supply source 9 is charged with a paint composition, and coloring materials if desired, through lines 10 and 11, from sources (not shown) of those materials. A plurality of heat exchange units 12 are also provided, one of which is positioned between each of the paint supply sources 9 and respective spray device 8 of a spray station 7, with communication provided between a paint supply source 9 and a heat exchange unit through a line 13 and with a line 14 connecting each heat exchange unit 12 with a respective paint spray device 8. With the present system, a heat exchange unit 12 is located closely adjacent to each paint spray device 8.

The heat exchange unit 12 is an indirect heat exchanger, preferably made from a metallic material, such as stainless steel, where a hot fluid is used to transfer heat to a supply of paint. Where an electrostatic spray device, such as an electrostatic rotary atomizer, is used as the paint spray device, the heat transfer fluid is preferably a high dielectric oil. As illustrated in the drawings, a common oil supply 15, such as a drum, is used to supply oil to a plurality of heat exchange units 12, with oil flow effected through oil transfer lines, such as inlet lines 16, communicating between a common supply 15 to a plurality of heat exchange units 12 and outlet lines 17 communicating between each of the plurality of heat exchange units 12 and the common oil supply 15, with the common oil supply 15 heated, such as by electric band heaters 16. Preferably, the common oil supply 15 is positioned outside the spray booth 3 with the oil transfer lines 17 and 18 passing through the walls 4 of the spray booth 3.

What is claimed is:

1. A method of spray painting an article, where the paint is heated to reduce the viscosity thereof prior to passage to a paint spray device, comprising:

providing a plurality of paint spray devices at a paint station;

providing a supply of paint to each of said paint spray devices;

providing a heat exchange unit for each of said paint spray devices at a location adjacent thereto so that the volume of heated paint supply between a said heat exchange unit and a respective paint spray device is about 15 percent or less of the paint volume of said heat exchange unit;

heating each said supply of paint in a respective heat exchange unit for each of said paint spray devices, wherein the heating is from a common supply of heated heat exchange fluid for a plurality of the heat exchange units; and spraying said article with said heated paint.

2. The method of spray painting an article as defined in claim 1 wherein said paint spray device comprises an electrostatic spray device and said paint is heated in each heat exchange unit by indirect heat transfer from a hot dielectric oil.

3. The method of spray painting an article as defined in claim 2 wherein the plurality of electrostatic spray devices are in a paint booth outside of which the common supply of oil is heated for indirect heating of said paint in each of said heat exchange units of said paint station by passage of a portion of said common supply of heated oil therethrough.

4. The method of spray painting an article as defined in claim 1 wherein only 100 to 1000 cc of paint is indirectly heated in a said heat exchanger at any point in time.

5. The method of spray painting an article as defined in claim 1 wherein only 10 to 150 cc of heated paint is provided between each said heat exchange unit and a respective paint spray device at any point in time.

6. The method of spray painting of an article as defined in claim 1 wherein said paint is heated in each said heat exchange unit from ambient temperature to a temperature of between about 100°–250° F.

7. The method of spray painting of an article as defined in claim 1 wherein said paint is comprised of two component reactive materials and each of said two components is separately heated in a said heat exchanger and then mixed together prior to entry into a said spray paint device.

8. A method of spray painting an article, where the paint is heated to reduce the viscosity thereof prior to passage to a paint spray device, comprising:

providing a plurality of electrostatic paint spray device at a paint station;

providing a supply of paint to each of said electrostatic paint spray devices;

providing a heat exchange unit for each of said electrostatic spray devices at a location adjacent thereto so that the volume of heated paint supply between a said heat exchange unit and a respective paint spray device is about 15 percent or less of the paint volume of said heat exchange unit;

heating each said supply of paint in a respective heat exchange unit for each of said electrostatic paint spray devices; and spraying said article with said heated paint.

9. The method of spray painting an article as defined in claim 8 wherein only 100 to 1000 cc of paint is heated in a said heat exchanger at any point in time.

10. The method of spray painting an article as defined in claim 8 wherein only 10 to 150 cc of heated paint is provided between each said heat exchange unit and a respective paint spray device at any point in time.

* * * * *